United States Patent [19]

Fertig

[11] Patent Number: 4,461,118

[45] Date of Patent: Jul. 24, 1984

[54] FLOWER ARRANGING VASE

[76] Inventor: Jilma Fertig, 12 E. 31st St., Apt. 1102, New York, N.Y. 10016

[21] Appl. No.: 299,596

[22] Filed: Sep. 4, 1981

[51] Int. Cl.[3] ..... A01G 5/04

[52] U.S. Cl. ..... 47/41 R

[58] Field of Search ..... 47/41, 41.1, 41.11, 47/41.12, 41.13, 83

[56] References Cited

U.S. PATENT DOCUMENTS

| | | | |
|---|---|---|---|
| 1,152,707 | 4/1939 | Orr | 47/41.1 |
| 1,200,459 | 10/1916 | Bode | 47/41.13 |
| 1,456,636 | 8/1923 | Gmelin | 47/41.13 X |
| 1,562,992 | 11/1925 | Schling | 47/41.13 X |
| 2,226,951 | 12/1940 | Simpson | 47/41.13 |
| 2,486,848 | 11/1949 | Huck | 47/41.13 X |
| 2,631,409 | 3/1953 | Windiate | 47/41.13 |
| 2,639,552 | 5/1953 | Tredup | 47/41.13 |

FOREIGN PATENT DOCUMENTS

| | | | |
|---|---|---|---|
| 9556 | 2/1895 | Fed. Rep. of Germany | 47/41.13 |
| 23881 | of 1912 | United Kingdom | 47/41.11 |
| 229931 | 3/1925 | United Kingdom | 47/41.11 |
| 304897 | 1/1929 | United Kingdom | 47/41.11 |

*Primary Examiner*—James R. Feyrer
*Assistant Examiner*—Danton DeMille
*Attorney, Agent, or Firm*—Richard L. Miller

[57] ABSTRACT

A flower arranging vase for displaying flower blossoms individually apart from each other, and around a side of the vase; the vase including a vessel perforated with holes through an upper portion of its side wall, so that flower stems can extend therethrough.

1 Claim, 4 Drawing Figures

Fig. 1
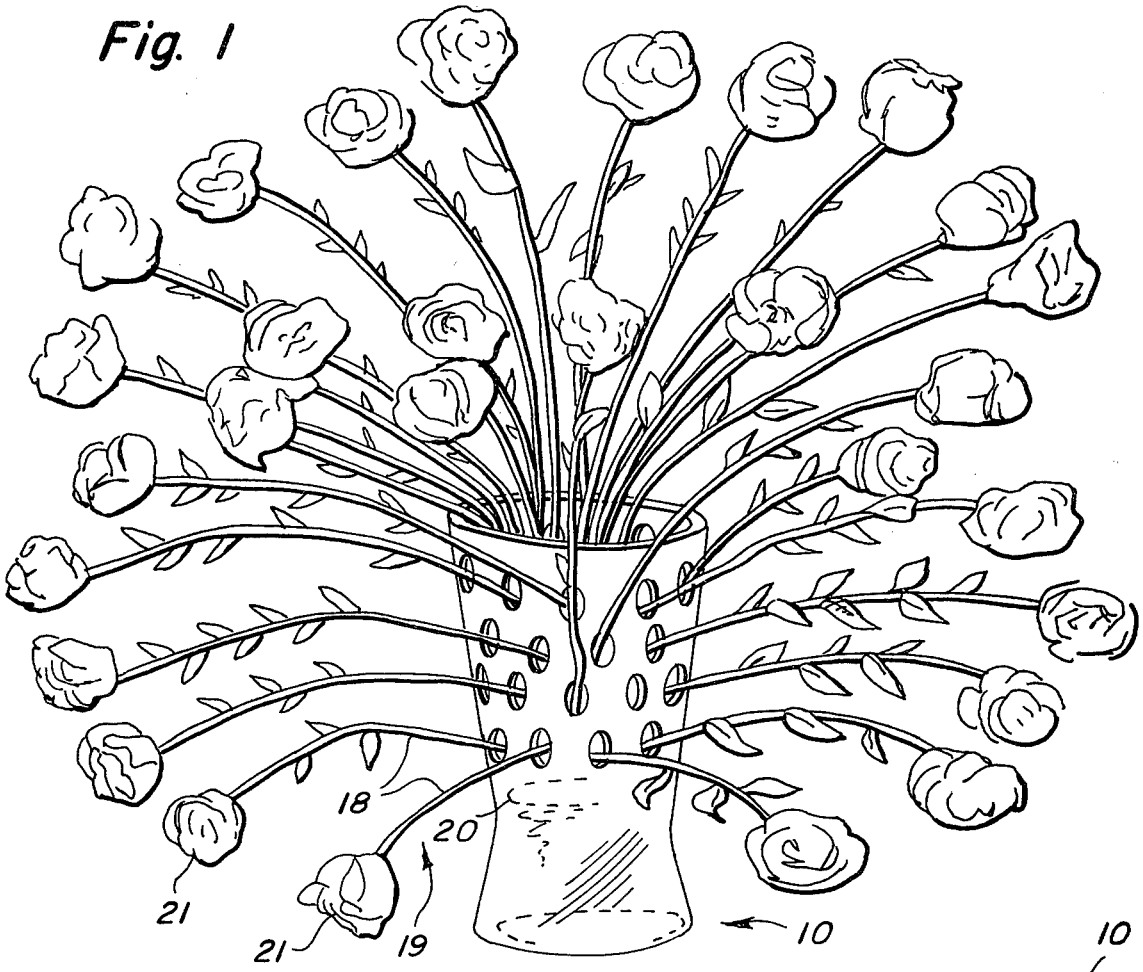
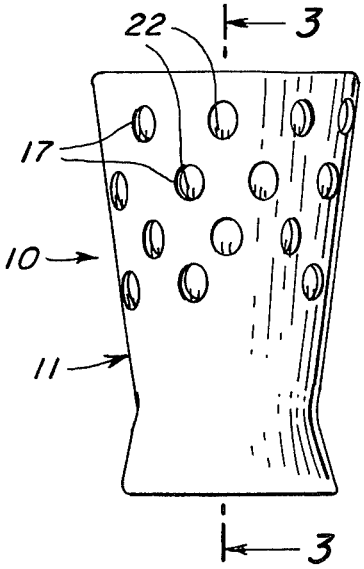
Fig. 2
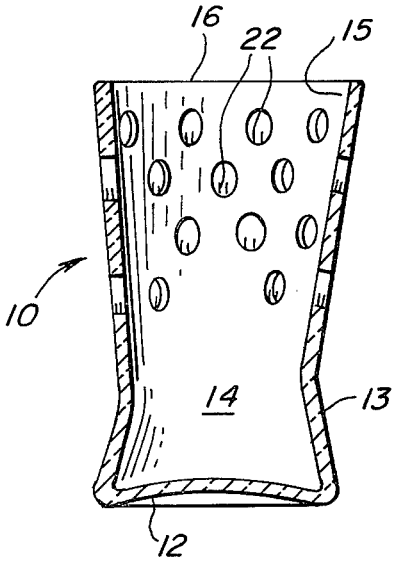
Fig. 3
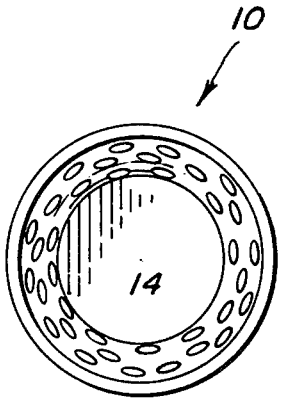
Fig. 4

FLOWER ARRANGING VASE

This invention relates generally to accessories for displaying cut flowers. More specifically it relates to vases used for holding cut flowers.

BACKGROUND OF THE INVENTION

It is well known that most cut flowers are displayed by being simply placed in a vessel such as a vase, containing fresh water so that the cut stem can absorb the water in order to keep the flower blossoms fresh. The blossoms are all located above the vessel due to the stems extending upward out of the vessel mouth.

SUMMARY OF THE INVENTION

A principal object of the present invention is to provide a vase which permits displaying the flower blossoms also around an outer side of the vessel, as well as above a top thereof.

Another object accordingly is to provide a vase which permits a larger display of the flower blossoms, so as to be more impressive to a viewer.

Yet a further object is to provide a flower arranging vase which accordingly holds a larger amount of cut flowers, as wished.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

A brief description of the drawing figures, is as follows:

FIG. 1 is a top perspective view of the invention shown in use.

FIG. 2 is a side elevational view.

FIG. 3 is a side cross sectional view taken on line 3—3 of FIG. 2.

FIG. 4 is a top view.

DETAILED DESCRIPTION OF THE PREFERRED EMBODIMENT

Referring now to the drawing in greater detail, the reference numeral 10 represents a flower arranging vase according to the present invention wherein there is a vessel 11 in the form of a decorative vase being made of glass, ceramic or other material conventionally used for decorative vases, and which is made also in any pleasing shape so as to appeal to an observer thereof.

The vessel includes generally a bottom wall 12 and a side wall 13 around a central compartment 14 which is accessible by a top opening or mount 15 formed by a lip 16 around a top edge of the side wall 13.

The vase may or may not include decorative handles around the outer side of the side wall 13.

In the present invention, a series of small holes 17 are made through an upper portion of the side wall 13, so that stems 18 of cut flowers 19 may be inserted therethrough, in order that the cut lower end of the stems may be submerged in water 20 that fills the lower portion of the compartment 14 up to the lowermost of the holes 17, while flower blossoms 21 on the upper end of the stems are thus displayed around the outer side of the vase. It is of course understood that some of the cut flowers may extend out of the vase mouth in a conventional manner, as also shown in FIG. 1, as preferred.

The holes 17 may be made one inch apart from each other in an average sized vase, or otherwise varied, depending upon the vase size of cut flowers that is intended to be displayed. The holes are preferably made all the same size, and their same distances apart, results in an attractive display arrangement wherein each flower obtains its own individual display space for the blossom, such as is not possible by crowded or sparse blossoms displayed from stems extending out of a vase mouth.

The holes may be made round or any other shape, as wished, and V-notched on a lower edge or lined with loop pile 22, shown in FIGS. 2, and 3, so as to prevent heavy blossoms from sliding a stem out of the hole.

while certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

I claim:

1. A flower arranging vase, comprising in combination, a vessel including a bottom and side wall around a central compartment for containing fresh water, a plurality of holes through an upper portion of said wall for cut flowers to extend therethrough, and loop pile material lining the interior surface of the bottom of at least some of said plurality of holes whereby stems of said cut flowers are prevented from sliding out of said holes by said loop pile.

* * * * *